United States Patent [19]

Schulz et al.

[11] 4,111,824

[45] * Sep. 5, 1978

[54] LIQUID DIELECTRIC COMPOSITION BASED ON A FRACTION DERIVED FROM THE ALKYLATION PRODUCT OF BENZENE WITH ETHYLENE

[75] Inventors: Johann G. D. Schulz, Pittsburgh; Charles M. Selwitz; Anatoli Onopchenko, both of Monroeville, all of Pa.

[73] Assignee: Gulf Research & Development Co., Pittsburgh, Pa.

[ * ] Notice: The portion of the term of this patent subsequent to Sep. 5, 1995, has been disclaimed.

[21] Appl. No.: 817,693

[22] Filed: Jul. 21, 1977

[51] Int. Cl.[2] ..... C10M 3/10; H01B 3/22

[52] U.S. Cl. ..... 252/63; 260/671 G; 260/674 A

[58] Field of Search ..... 252/63; 260/671 R, 671 G, 260/674 A; 361/315, 327; 174/17 LF

[56] References Cited

U.S. PATENT DOCUMENTS

| | | | |
|---|---|---|---|
| 2,403,785 | 7/1946 | Britton et al. | 260/671 R |
| 2,653,979 | 9/1953 | Kropa et al. | 252/63 X |
| 3,600,298 | 8/1971 | Mayumi et al. | 260/671 G X |
| 3,786,107 | 1/1974 | Kuribayasni et al. | 260/671 G X |
| 4,011,274 | 3/1977 | Watanabe et al. | 260/671 R X |
| 4,033,854 | 7/1977 | Ohmori et al. | 252/63 X |

FOREIGN PATENT DOCUMENTS 732,900 6/1955 United Kingdom.

*Primary Examiner*—Harris A. Pitlick

[57] ABSTRACT

A liquid dielectric composition obtained as a result of a process which comprises reacting benzene with ethylene in the presence of an alkylation catalyst to obtain an alkylation product containing largely unreacted benzene, ethylbenzene, polyethylbenzenes and heavier products, separating benzene, ethylbenzene and polyethylbenzenes from said alkylation product and thereafter recovering from said heavier products the entire fraction whose boiling point is in the temperature range of about 255° to about 420° C., preferably about 260° to about 400° C., most preferably about 268° to about 400° C., as said liquid dielectric composition.

6 Claims, No Drawings

LIQUID DIELECTRIC COMPOSITION BASED ON A FRACTION DERIVED FROM THE ALKYLATION PRODUCT OF BENZENE WITH ETHYLENE

BACKGROUND OF THE INVENTION

1. Field of the Invention

The invention defined herein relates to a liquid dielectric composition obtained as a result of a process which comprises reacting benzene with ethylene in the presence of an alkylation catalyst to obtain an alkylation product containing largely unreacted benzene, ethylbenzene, polyethylbenzenes and heavier products, separating benzene, ethylbenzene and polyethylbenzenes from said alkylation product and thereafter recovering from said heavier products the entire fraction whose boiling point is in the temperature range of about 255° to about 420° C., preferably about 260° to about 400° C., most preferably about 268° to about 400° C., as said liquid dielectric composition.

2. Description of the Prior Art

Polychlorinated biphenyls have been extensively employed commercially in the electrical industry over a long period of time as liquid insulating fluids, but because of environmental and toxicological problems associated therewith, substitutes therefore are required.

SUMMARY OF THE INVENTION

We have found that a liquid dielectric composition can be obtained from a process which comprises reacting benzene with ethylene in the presence of an alkylation catalyst to obtain an alkylation product containing largely unreacted benzene, ethylbenzene, polyethylbenzenes and heavier products, separating benzene, ethylbenzene and polyethylbenzenes from said alkylation product and thereafter recovering from said heavier products the entire fraction whose boiling point is in the temperature range of about 255° to about 420° C., preferably about 260° to about 400° C., most preferably about 268° to about 400° C., as said liquid dielectric composition.

BRIEF DESCRIPTION OF THE INVENTION

In the alkylation of benzene with ethylene an alkylation product is obtained containing largely unreacted benzene, ethylbenzene, polyethylbenzenes and a higher-boiling product. From said alkylation product the unreacted benzene, ethylbenzene and polyethylbenzenes are recovered and said higher-boiling product is said to have only fuel value. In U.S. Pat. No. 4,011,274, dated Mar. 8, 1977, Watanke et al recover from said higher-boiling product 1,1-diphenylethane and state that the resulting residue is still available as fuels. In the present application we have found, unexpectedly, that from said higher-boiling product we can obtain an entire fraction, defined below, useful as liquid dielectric compositions.

Briefly, the process employed in obtaining the new liquid dielectric compositions defined and claimed herein comprises reacting benzene with ethylene in the presence of an alkylation catalyst to obtain an alkylation product containing largely unreacted benzene, ethylbenzene, polyethylbenzenes and heavier, still higher-boiling, products, separating benzene, ethylbenzene and polyethylbenzenes from said alkylation product and thereafter recovering from said heavier products the entire fraction whose boiling point is in the temperature range of about 255° to about 420° C., preferably about 260° to about 400° C., most preferably about 268° to about 400° C., as said liquid dielectric composition.

The alkylation of benzene with ethylene that can be employed to obtain the new liquid dielectric compositions claimed herein can be any of the processes known in the art for producing a product containing ethylbenzene, for example, either liquid phase alkylation or vapor phase alkylation. The molar ratios of benzene to ethylene employed can be, for example, in the range of about 25:1 to about 2:1, preferably about 10:1 to about 3:1. In the liquid phase reaction, for example, the benzene and ethylene, together with an alkylation catalyst, for example, a Friedel Crafts catalyst, such as aluminum chloride or aluminum bromide or some other organo-aluminum halide; Lewis acids, such as promoted $ZnCl_2$, $FeCl_3$ and $BF_3$; and Bronsted acids, including sulfuric acid, sulfonic acid and p-toluene sulfonic acid, hydrofluoric acid, etc., in an amount corresponding to about 0.002 to about 0.050 parts, preferably about 0.005 to about 0.030 parts, relative to ethylbenzene produced, are reacted in a temperature range of about 20° to about 175° C., preferably about 90° to about 150° C., and a pressure in the range of about atmospheric to about 250 pounds per square inch gauge (about atmospheric to about 17.6 kilograms per square centimeter), preferably about 7 to about 200 pounds per square inch gauge (about 0.5 to about 14 kilograms per square centimeter), for about 10 minutes to about 10 hours, preferably for about 20 minutes to about 3 hours. In the vapor phase, for example, the reactants can be passed over a suitable alkylation catalyst bed containing alkylation catalysts, such as phosphoric acid on kieselguhr, silica or alumina, aluminum silicates, etc. at a convenient hourly space velocity in a temperature range of about 250° to about 450° C., preferably about 300° to about 400° C., and a pressure of about 400 to about 1200 pounds per square inch gauge (about 28 to about 85 kilograms per square centimeter), preferably about 600 to about 1000 pounds per square inch gauge (about 42 to about 70 kilograms per square centimeter).

As a result of such reactions, an alkylation product is obtained containing unreacted benzene, the desired ethylbenzene, polyethylbenzenes, such as diethylbenzene and triethylbenzene, and higher-boiling products.

The alkylation product can be treated in any conventional manner to remove any alkylation catalyst present therein. For example, when aluminum chloride is used as catalyst, the alkylation product can be sent to a settler wherein the aluminum chloride complex is removed and recycled to the reaction zone and the remaining product can then be water washed and neutralized.

The resulting alkylation product is then distilled at atmospheric pressure or under vacuum to recover unreacted benzene (B.P. 80° C.), ethylbenzene (B.P. 136° C.) and polyethylbenzenes (B.P. 176°–250° C.).

The heavier product remaining after removal of benzene, ethylbenzene and polyethylbenzenes, as described above, is a dark, viscous, high-boiling material from which the novel liquid dielectric compositions defined and claimed herein are obtained. To obtain the claimed novel liquid dielectric composition, the said heavier product is simply subjected to distillation and the entire fraction recovered whose boiling point at atmospheric pressure (14.7 pounds per square inch gauge or 760 millimeters of mercury) is in the temperature range of about 255° to about 420° C., preferably about 260° to about 400° C., most preferably about 268° to about 400° C., constitutes the desired and novel liquid dielectric composition. That portion whose boiling point is in the range of about 255° to about 420° C. will contain a maximum of about 20 weight percent 1,1-diphenylethane, that portion whose boiling point is in the range of about 260° to about 400° C. will contain a maximum of about 25 weight percent 1,1-diphenylethane and that portion whose boiling point range is in the range of about 268° to about 400° C. will contain a maximum of about 30 weight percent, 1,1-diphenylethane. The remaining heavier material or residue is a black asphalt-like material solid at ambient temperature believed, in part, to be polynuclear structure having fuel value only.

DESCRIPTION OF PREFERRED EMBODIMENTS

A number of liquid dielectric compositions were prepared from the residue, or heavier products, obtained as a result of the production of ethylbenzene. This residue was obtained as follows. Benzene and ethylene in a molar ratio of 9:1 were contacted in the liquid phase, while stirring, in a reactor at a temperature of 130° C. and a pressure of 70 pounds per square inch gauge (4.9 kilograms per square centimeter) in the presence of $AlCl_3$ catalyst over a period of 1 hour, which was sufficient to convert all of the ethylene. The $AlCl_3$ complex catalyst was prepared by dissolving $AlCl_3$ in a polyethylbenzene cut from a previous run so that after the addition the composition of the catalyst complex was as follows: 31.5 weight percent $AlCl_3$, 7.0 weight percent benzene, 19.3 weight percent ethylbenzene, 29.8 weight percent polyalkylated benzenes, 3.4 weight percent 1,1-diphenylethane and 9.0 weight percent higher-boiling components. The amount of $AlCl_3$ present in the catalyst mixture amounted to 0.0034 parts by weight per one part by weight of ethylbenzene produced. Also present in the catalyst was ethyl chloride promoter in an amount corresponding to 0.0034 parts by weight per one part by weight of ethylbenzene produced to maintain a high catalyst efficiency. Analysis of the alkylation product showed the presence of 49.0 weight percent benzene, 32.9 weight percent ethylbenzene, 17.5 weight percent of polyalkylated benzenes (6.0 weight percent diethylbenzene, 2.7 weight percent triethylbenzenes, 2.1 weight percent tetraethylbenzenes and 6.7 weight percent other alkylbenzenes), 0.1 weight percent 1,1-diphenylethane and 0.4 weight percent residue. The alkylation product was subjected to distillation to recover unreacted benzene, ethylbenzene and polyalkylated benzenes, and the benzene and polyalkylated benzenes were recycled to the reaction zone. The residue remaining was a dark, viscous, high-boiling material, and was produced in an amount corresponding to 0.014 parts for each part of ethylbenzene produced. By using aged aluminum chloride complex, the amount of high-boiling residue formed can be increased substantially.

The residue obtained above was subjected to distillation at atmospheric pressure and a fraction was recovered having a boiling point at atmospheric pressure of 260° to 400° C. and subjected to tests (ASTM-D924) at 25° C. to determine its power factor and its dielectric strength. When this fraction was subjected to the above tests the following results were obtained: Dielectric Strength, Kv: 50 and Power Factor, Percent: 0.08.

It is understood that the present compositions can be further treated, if desired, for example, to further improve their properties for a particular purpose, for example, to improve their flash point, interfacial tension, pour point, viscosity, oxidation stability, corrosion resistance, etc. For example, the power factor of the composition claimed herein can be further improved by recovering said composition from the heavier products defined herein by distillation in the presence of basic materials, such as Group I and Group II alkali metals and alkaline earth metals, their oxides and hydroxides, as defined in our copending U.S. patent application Ser. No. 817,694, entitled Liquid Dielectric Composition, filed concurrently herewith.

Obviously, many modifications and variations of the invention, as hereinabove set forth, can be made without departing from the spirit and scope thereof, and therefore only such limitations should be imposed as are indicated in the appended claims.

We claim:

1. A liquid dielectric composition obtained as a result of a process which comprises reacting benzene with ethylene in the presence of an alkylation catalyst to obtain an alkylation product containing largely unreacted benzene, ethylbenzene, polyethylbenzenes, 1,1-diphenylethane and heavier products, separating benzene, ethylbenzene and polyethylbenzenes from said alkylation product and thereafter recovering from said heavier products the entire fraction whose boiling point is in the temperature range of about 255° to about 420° C. as said liquid dielectric composition.

2. The composition of claim 1 wherein the boiling point of said fraction is in the range of about 260° to about 400° C.

3. The composition of claim 1 wherein the boiling point of said fraction is in the range of about 268° to about 400° C.

4. The composition of claim 1 wherein said catalyst is $AlCl_3$.

5. The composition of claim 1 wherein said benzene and said ethylene are reacted in the presence of $AlCl_3$ in a temperature range of about 20° to about 175° C.

6. The composition of claim 1 wherein said benzene and said ethylene are reacted in the presence of $AlCl_3$ in a temperature range of about 90° to about 150° C.

* * * * *